US007104166B1

(12) United States Patent
Wong

(10) Patent No.: US 7,104,166 B1
(45) Date of Patent: Sep. 12, 2006

(54) MULTI-PURPOSE LOCKING PLIER

(75) Inventor: Harry Wong, South Pasadena, CA (US)

(73) Assignee: Valtra, Inc., Pico Rivera, CA (US)

( * ) Notice: Subject to any disclaimer, the term of this patent is extended or adjusted under 35 U.S.C. 154(b) by 16 days.

(21) Appl. No.: 11/117,254

(22) Filed: Apr. 28, 2005

(51) Int. Cl.
*B25B 7/02* (2006.01)
*B25B 13/58* (2006.01)

(52) U.S. Cl. ..... 81/423; 81/180.1

(58) Field of Classification Search ..... 81/418, 81/420, 423, 426, 367, 368, 376, 377, 378
See application file for complete search history.

(56) References Cited

U.S. PATENT DOCUMENTS 3,807,718 A * 4/1974 Sendoykas ..... 269/6
4,673,174 A * 6/1987 Tabbert ..... 269/41
5,660,069 A * 8/1997 Williams ..... 72/211
5,788,809 A * 8/1998 Brennan ..... 156/581
5,931,453 A * 8/1999 Brennan ..... 269/258
6,009,608 A * 1/2000 Peckham ..... 29/268

* cited by examiner

*Primary Examiner*—David B. Thomas

(57) ABSTRACT

A clamping device utilizing the mechanism of conventional vise-grip locking pliers comprises an extendable fixed arm and an extendable movable arm, both fitted with threaded holes at one end to attach a wide variety of clamping jaws and accessories. The device is capable of clamping workpieces of various shapes such as rectangular, cylindrical, triangular, and spherical, etc. with adjustable clamping force. It is also capable of clamping workpieces of a broad range of sizes, and capable of clamping a plurality of workpieces at the desired spatial relationship between each other.

12 Claims, 11 Drawing Sheets

MULTI-PURPOSE LOCKING PLIER

REFERENCE CITED

U.S. Patent Documents

| | | |
|---|---|---|
| 2,641,149 | June 1953 | Christian Petersen |
| 4,305,575 | December 1981 | Dale L. Bardes |
| 4,344,215 | August 1982 | Timothy C. Dearman |
| 4,477,937 | October 1984 | James Costello |
| 4,542,669 | September 1985 | Philippe Roux |
| 4,850,254 | July 1989 | Burrell T. Burney |
| 5,022,290 | June 1991 | Thomas F. Duffy |
| 5,469,766 | November 1995 | Joseph M. Hodges |
| 5,499,800 | March 1996 | Stephen D. Albin |
| 6,012,362 | January 2000 | Chao-Chi Wang |
| 6,389,937 | May 2002 | Hsin-Fa Kang |

BACKGROUND OF THE INVENTION

1. Field of the Invention

The present invention relates to a class of locking pliers, or vise grips in general, and more particularly to multi-purpose locking pliers with extendable clamping arms and threaded holes on clamping arms to attach a wide variety of clamping jaws and accessories. The invention is capable of clamping workpieces of various shapes such as rectangular, cylindrical, triangular, and spherical, etc. with adjustable clamping force. It is also capable of clamping workpieces within a broad range of sizes.

2. Description of the Related Art

A conventional locking plier or vise grip generally comprises a fixed arm with clamping jaw, a movable arm attached with clamping jaw and a toggling linkage mechanism attached between the movable arm and the fixed arm. To serve various applications, there are many different designs of the clamping jaws for locking pliers in the field, such as: C-shape clamping arm with round tips used in the Gripping Tool, U.S. Pat. No. 2,641,149; L-shape jaws used in Toe-nailing Clamping Tool, U.S. Pat. No. 4,305,575; V-shape jaws for cylindrical pipe clamping, U.S. Pat. No. 4,344,215; combination of wrench and chain clamping jaws, U.S. Pat. No. 4,477,937; long nose jaws for external and internal clamping, U.S. Pat. No. 4,542,669; combination of vise grip and bar clamp, U.S. Pat. No. 4,850,254; adjustable locking jaws, U.S. Pat. No. 5,022,290; C-shape arm with hole and clip, U.S. Pat. No. 5,469,766; adjustable locking bar clamp, U.S. Pat. No. 5,499,800; V-shape toothed jaws, U.S. Pat. No. 6,012,362; and cylindrical jaws for clamping various sizes pipes, U.S. Pat. No. 6,389,937; etc. However, almost all of these prior arts are single-purpose oriented, some of them may serve more than one purposes, but still very limited in application and flexibility. A number of locking pliers, each with different design features will be required to serve a number of different work holding jobs. Furthermore, the size of a workpiece that can be manipulated on is limited by the physical size of most of these prior arts. In other words, to clamp a workpiece of significantly different dimension will require a similar tool of the appropriate size. It is the intention of the present invention to provide a handy tool to work on workpieces within a broad range of physical sizes. Another intention is to enable the adjustment of the clamping force on a workpiece by turning an adjustment screw. Further intention of the present invention is to provide a convenient means to increase the clamping force on a workpiece by inserting a metal rod or any suitable screwdriver into the hole equipped on the adjustment screw to act as a handle to increase the turning torque. Yet another intention of the invention is to provide a simple means to adjust the workable gap between the clamping jaws of the invention. An additional intention of the present invention is to increase the functionality by attaching a wide variety of clamping jaws and accessories to work on workpieces of different shapes in various ways.

SUMMARY OF THE INVENTION

The present invention comprises a fixed handle to which a L-shape extendable fixed arm with screw-in jaw is attached, a movable handle to which a L-shape extendable movable arm with screw-in jaw is pivotally mounted, a toggling linkage mechanism pivotally connected between the fixed handle and the movable handle, an adjustment screw inserted into the free end of the fixed handle, a plurality of clamping jaws and a plurality of attachable accessories. The fixed handle, the movable handle, the adjustment screw and the toggling linkage mechanism are similar in design as the conventional locking pliers. The principle of operations of these parts will not be discussed here again.

The L-shape extendable fixed arm comprises an upper L-shape metal shank, a first upper straight shank with inverted U-shape cross section riveted to one end of the upper L-shape metal shank, and a second upper straight shank made of solid metal inserted into the first upper straight shank. The second upper straight shank, similar in length as and slidable inside the first upper straight shank, can be fixed at a plurality of positions with screws and nuts through a plurality of holes on the bodies of both the first upper straight shank and the second upper straight shank. The L-shape extendable movable arm comprises a lower L-shape metal shank, a first lower straight shank with U-shape cross section riveted to one end of the lower L-shape metal shank, and a second lower straight shank made of solid metal inserted into the first lower straight shank. The second lower straight shank, similar in length as and slidable inside the first lower straight shank can be fixed at a plurality of positions with screws and nuts through a plurality of holes on the bodies of both the first lower straight shank and the second lower straight shank. Such construction enables the user to extend the effective length of both the fixed arm and the movable arm to the required length matching the size of the workpiece to be clamped. Since the fixed arm and the movable arm are individually extendable, each arm can be extended to a plurality of length combinations to suit special needs of various applications.

The free end of the second upper straight shank is shaped as a vertical cylinder with a threaded hole cutting through its centerline. The threaded hole is made to accept various types of clamping jaws or accessories designed for various applications. The free end of the second lower straight shank is shaped as a vertical cylinder with a threaded hole cutting through its centerline. The threaded hole is made to accept various types of clamping jaws or accessories designed for various applications. The L-shape design of both the fixed arm and the movable arm increases the effective clamping gap between the jaws so that the present invention can be used to clamp thicker workpieces.

Clamping jaws include a wide variety of designs. For example, a threaded rod with a fixed clamping pad, a threaded rod with a swivel clamping pad to clamp workpiece with inclined or curved surface so that the clamping pad will sit properly on the surface; a threaded rod with rubber clamping pad for workpieces of smooth and slippery surfaces; a clamping jaw with longer threaded rod for step-over clamping and easy adjustment of the clamping gap to suit various thicknesses of workpieces; and a yoke assembly to clamp two workpieces together and to fix them at the desired spatial relationship; etc.

Different types of accessories can be attached with screws to the present invention for particular applications. For example, a V-pad for clamping cylindrical workpieces; a 90 degree V-angle bracket for joining two cylindrical workpieces at 90 degree relationship; a 90 degree L-angle bracket for joining two rectangular workpieces at 90 degree relationship; a 180 degree V-angle bracket to join two cylindrical workpieces in-line; a 180 degree L-angle bracket for holding two rectangular workpieces in-line; a L-shape link to join two pieces of the present invention together to clamp more workpieces at the same time; and a L-shape clamping arm with round tip for regular grip; etc.

A cylindrical hole is made perpendicular to the axis of the adjustment screw for inserting a metal rod or a screwdriver to increase the turning torque of the adjustment screw. For some application, when a workpiece is clamped with the present invention, a greater clamping force may be required. Under clamping condition, turning the adjustment screw further by fingers will increase the clamping force to a certain degree. However, the turning torque may not be strong enough to achieve the desired clamping force, then the inserted screwdriver will help in this situation.

DETAILED DESCRIPTION OF THE INVENTION

With the help of the drawings and the detail description below, the features of the present invention will be apparent and fully understandable.

Figure 1:
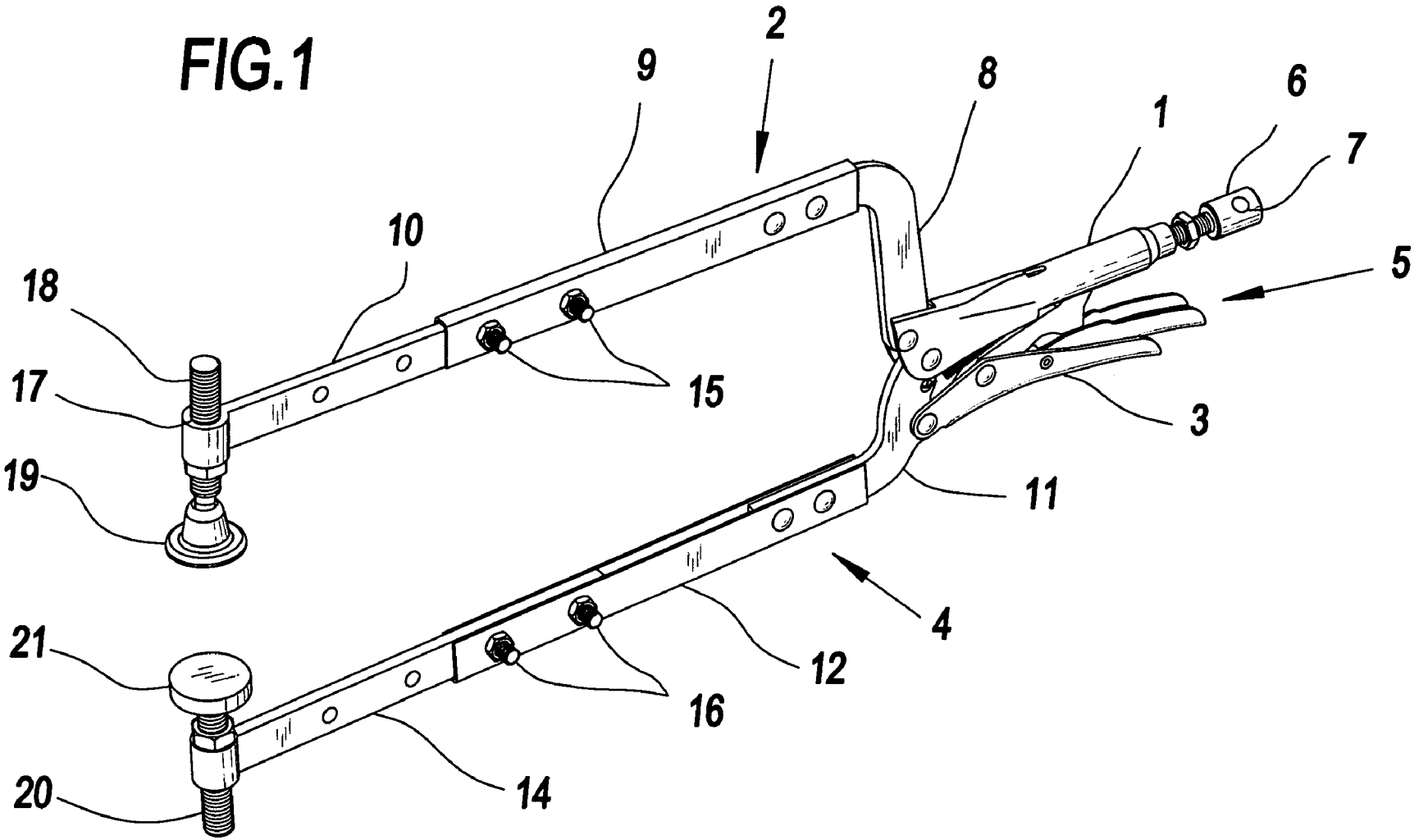
FIG. 1 is a perspective view of the present invention with the fixed arm and the movable arm extended, attaching a threaded rod with swivel clamping pad and a threaded rod with fixed clamping pad respectively.
Figure 2:
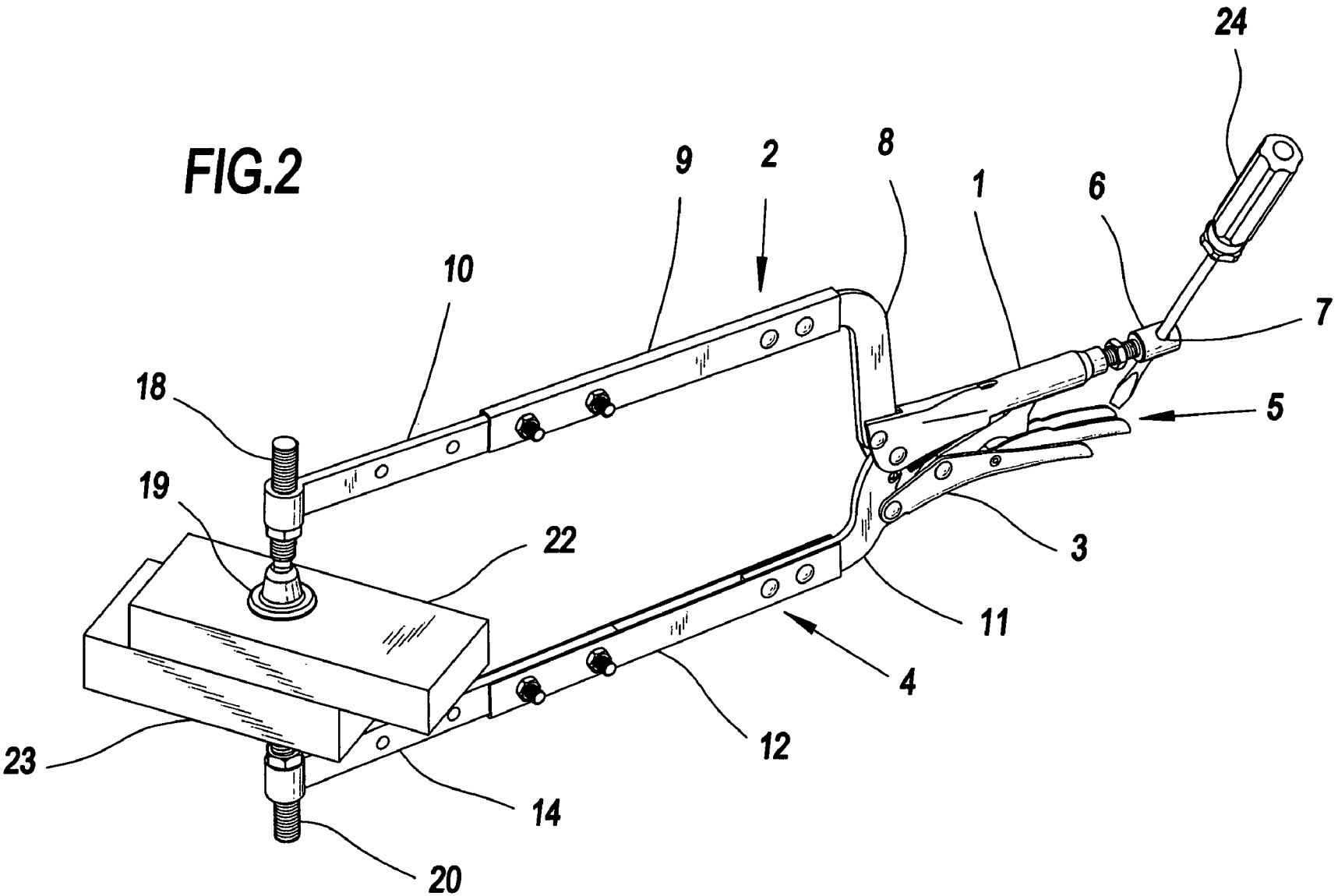
FIG. 2 is a perspective view of the present invention clamping two workpieces, and a screwdriver inserted into the hole of the adjustment screw.
Figure 3:
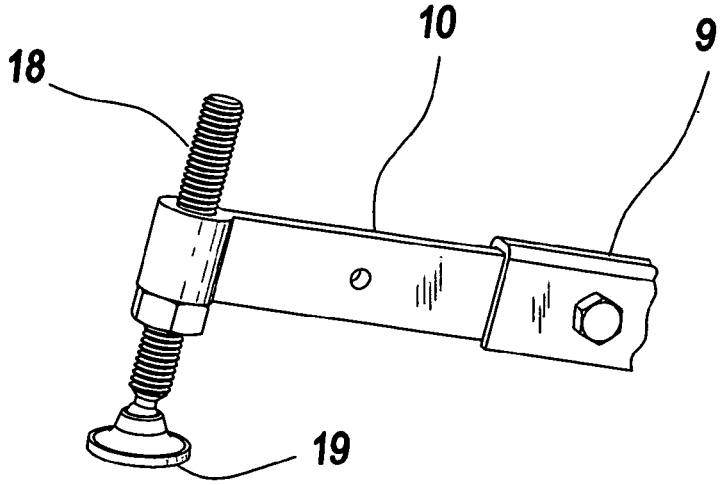
FIG. 3 is a perspective view of part of the fixed arm attaching a threaded rod with swivel clamping pad.

Referring to FIG. 1, the present invention comprises a fixed handle 1 to which a L-shape extendable fixed arm 2 is attached and a movable handle 3 to which a L-shape extendable movable arm 4 is pivotally mounted. The fixed handle 1 is connected to the movable handle 3 with the toggling linkage mechanism 5 and the L-shape extendable movable arm 4 through pivots and spring the same way as a conventional locking plier. The free end of the fixed handle 1 is cylindrical in shape and threaded internally to accept the adjustment screw 6 for the adjustment of the clamping gap and clamping force of the present invention. Cylindrical hole 7 is made perpendicular to the axis of the adjustment screw 6 so that a screwdriver 24 or any metal rod of the proper size can be inserted, as shown in FIG. 2 to increase the turning torque when a greater clamping force is required. The L-shape extendable fixed arm 2 comprises an upper L-shape metal shank 8, a first upper straight shank 9 with inverted U-shape cross section riveted to the free end of the upper L-shape metal shank 8, and a second upper straight shank 10 made of solid metal inserted into the first upper straight shank 9. The second upper straight shank 10, similar in length as and slidable inside the first upper straight shank 9, is fixed at a plurality of positions with screws and nuts 15 through a plurality of holes on the bodies of both the first upper straight shank 9 and the second upper straight shank 10. The L-shape extendable movable arm 4 comprises a lower L-shape metal shank 11, a first lower straight shank 12 with U-shape cross section riveted to the free end of the lower L-shape metal shank 11, and a second lower straight shank 14 made of solid metal inserted into the first lower straight shank 12. The second lower straight shank 14, similar in length as and slidable inside the first lower straight shank 12, is fixed at a plurality of positions with screws and nuts 16 through a plurality of holes on the bodies of both the first lower straight shank 12 and the second lower straight shank 14. The free end of the second upper straight shank 10 is a vertical cylinder and made with a first threaded hole 17 cutting through its centerline to accept various types of clamping jaws, a round swivel clamping pad 19 attaching to a threaded rod 18 as an example shown in FIG. 1. The free end of the second lower straight shank 14 is a vertical cylinder and made with a second threaded hole (not shown) cutting through its centerline to accept various types of clamping jaws, a fixed clamping pad 21 attaching to a threaded rod 20 as an example shown in FIG. 1. Swivel clamping pad 19, as shown in FIG. 1 and FIG. 3, is used to clamp workpiece with inclined or curved surface so that the swivel clamping pad 19 will sit properly on the surface. Fixed clamping pad 21 provides a stable platform to support the workpiece. Threaded rods 18 and 20 provide an additional means to adjust the clamping gaps to suit different workpieces. FIG. 2 shows two workpieces 22 and 23 being clamped between swivel clamping pad 19 and fixed clamping pad 21 (not shown).

Figure 4:
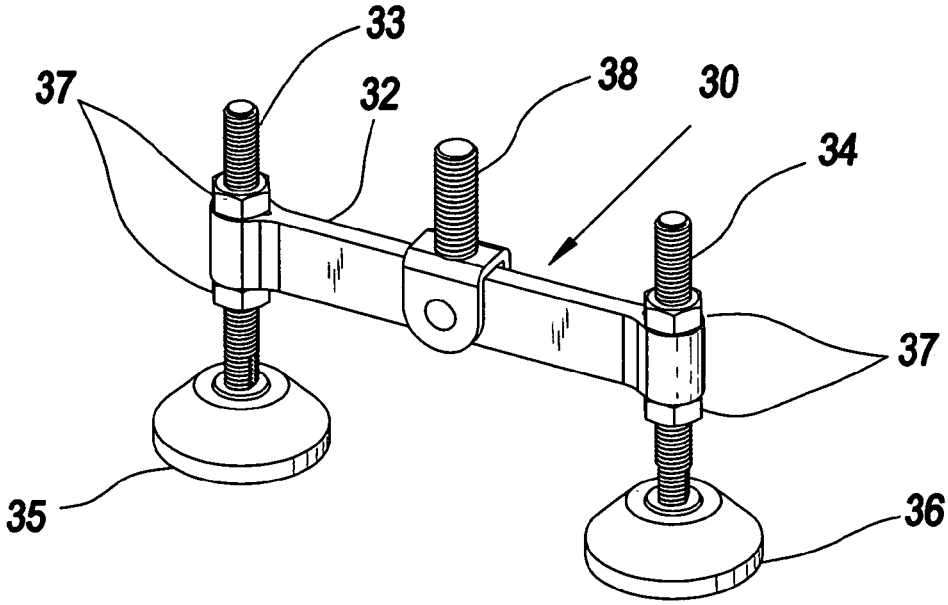
FIG. 4 is a perspective view of the yoke assembly.
Figure 5:
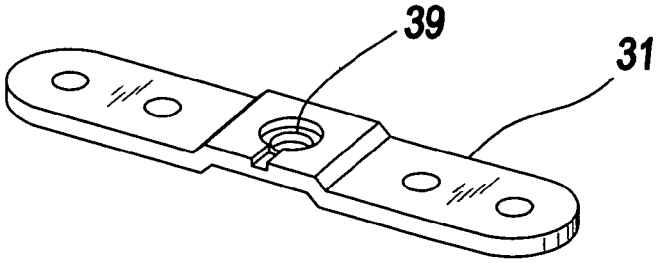
FIG. 5 is a perspective view of the support bar.
Figure 6:
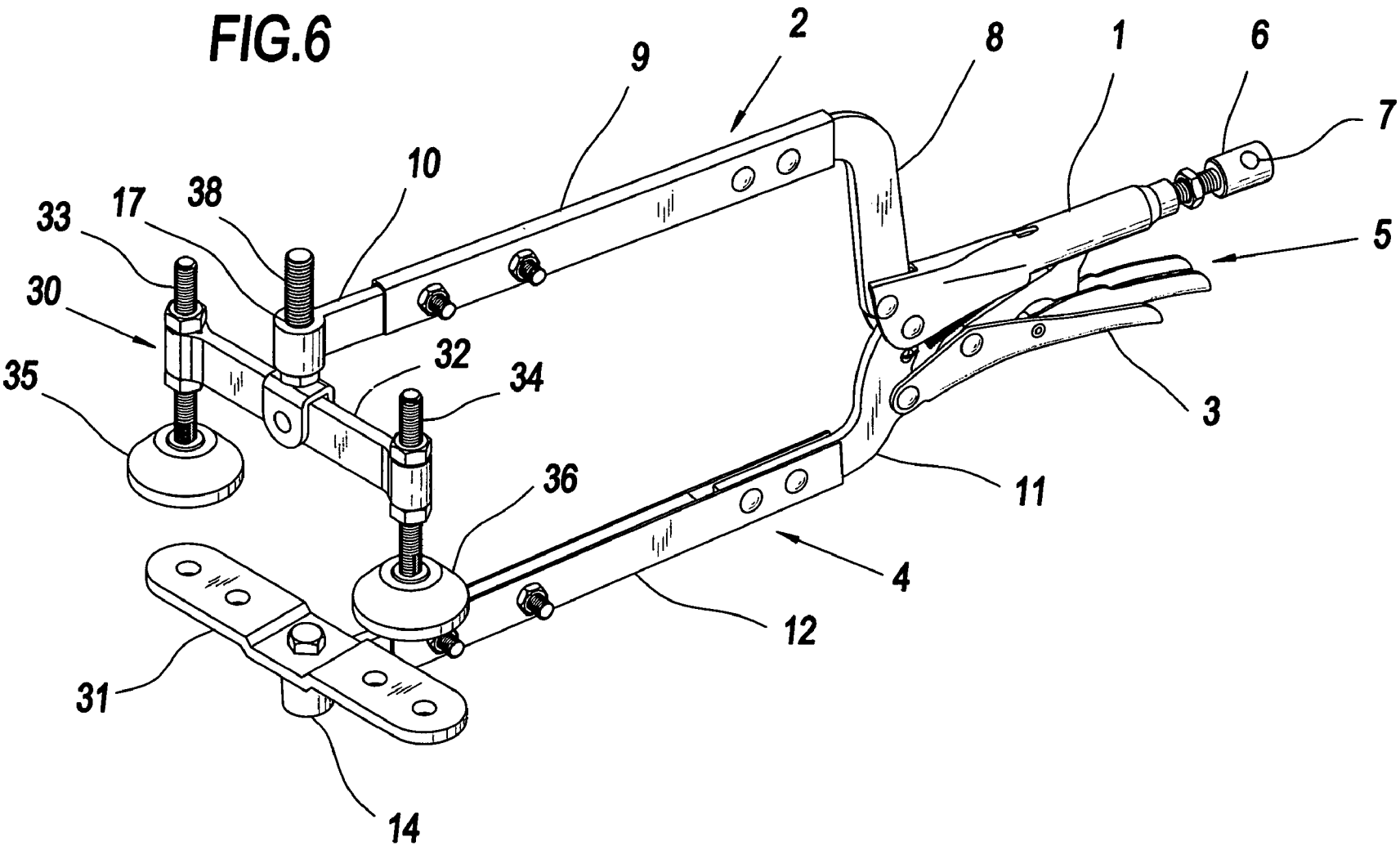
FIG. 6 is a perspective view of the present invention with both the fixed arm and the movable arm retracted and mounted with the yoke assembly and support bar respectively.
Figure 7:
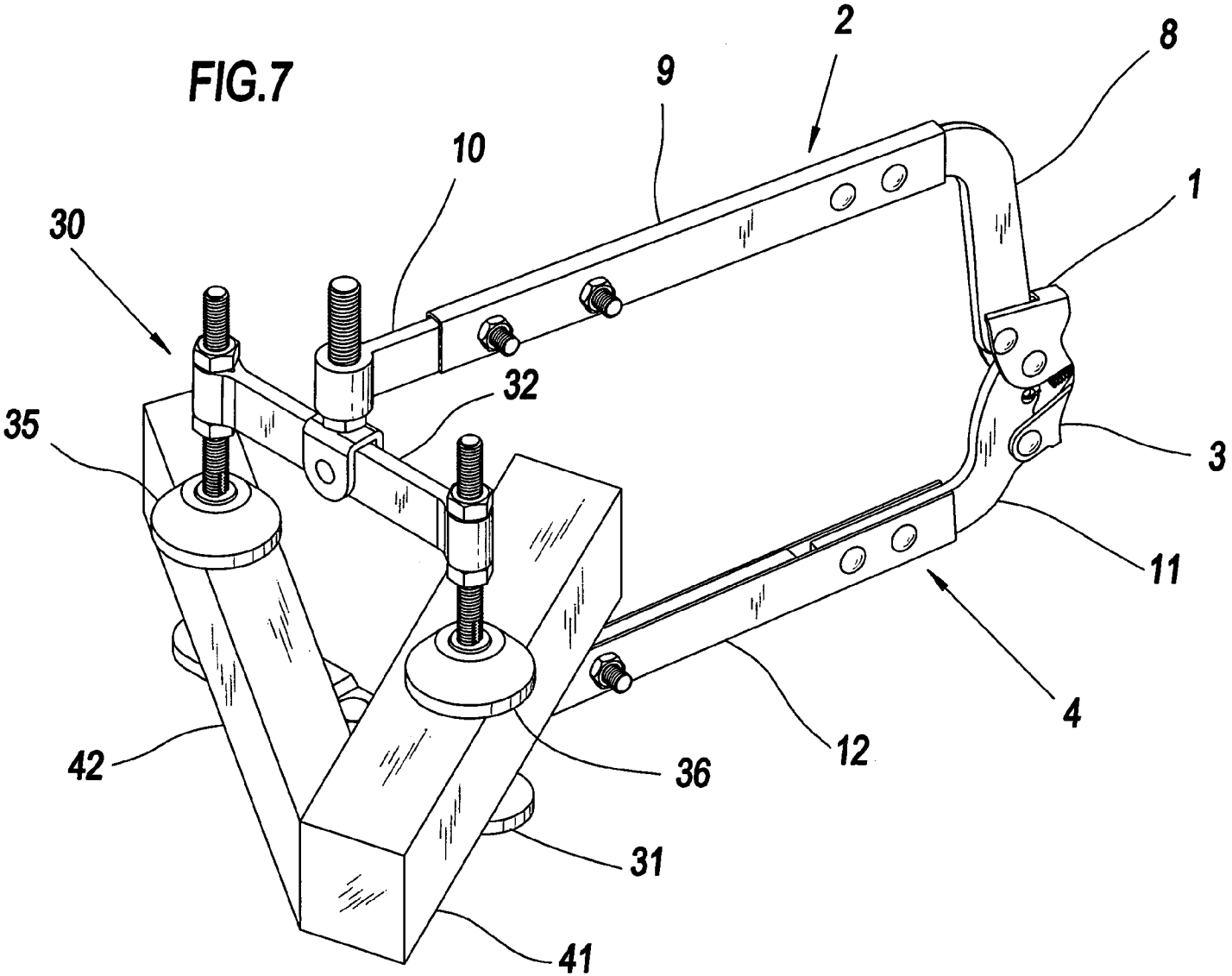
FIG. 7 is a perspective view of part of the present invention clamping two workpieces between the yoke assembly and the support bar at a particular spatial relationship.

FIG. 4 shows a yoke assembly 30 and FIG. 5 shows the support bar 31. The yoke assembly 30 consists of a horizontal straight metal bar 32 with a vertical threaded hole at each end (not shown). Each threaded hole is inserted a threaded rod 33 and 34 with clamping pads 35 and 36 respectively. The position of each clamping pads, 35 and 36 relative to the metal bar 32 is adjustable by turning the threaded rods 33 and 34 accordingly and can be locked in position by nuts 37. In the middle of the metal bar 32, a short threaded rod 38 is hinged. This short threaded rod 38 can be inserted into the first threaded hole 17 of the second upper straight shank 10. Hence the yoke assembly 30 acts as clamping jaws to clamp workpiece of uneven surface or to clamp two workpieces at the same time. Support bar 31 is a straight metal bar with a recess hole 39 in the middle so that it can be fixed to the second lower straight shank 14 with a screw. FIG. 6 shows how the yoke assembly 30 is attached to the second upper straight shank 10 and the support bar 31 is attached to the second lower straight shank 14 of the present invention. FIG. 6 also shows that both the second upper straight shank 10 and the second lower straight shank 14 are set to the retracted position. FIG. 7 shows how one set of the present invention can be used with the yoke assembly 30 and support bar 31 to clamp two workpieces 41 and 42 at a particular spatial relationship.

Figure 8:
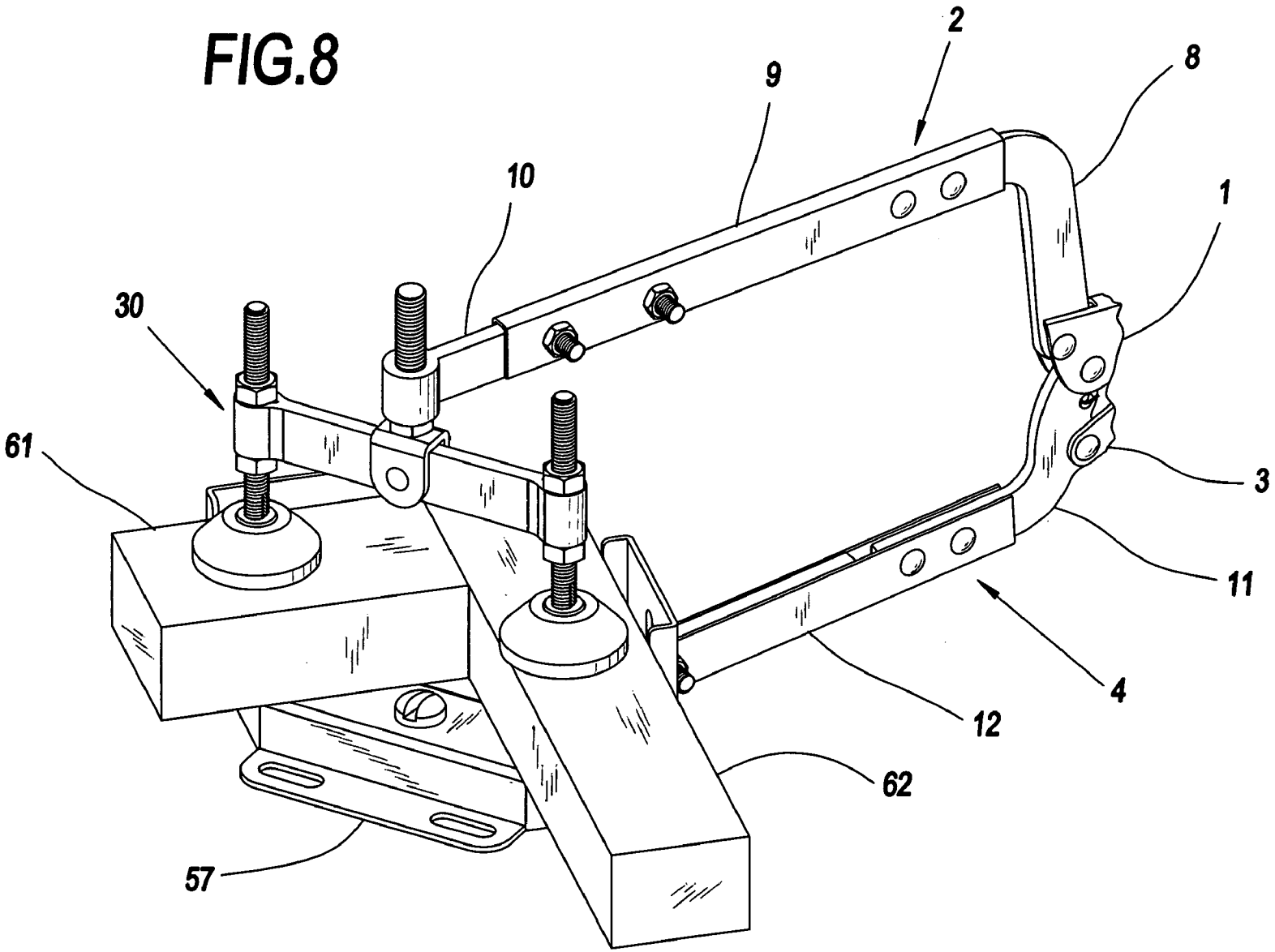
FIG. 8 is a perspective view of part of the present invention clamping two workpieces between the yoke assembly and the 90 degree L-angle bracket at 90 degree relationship.
Figure 9:
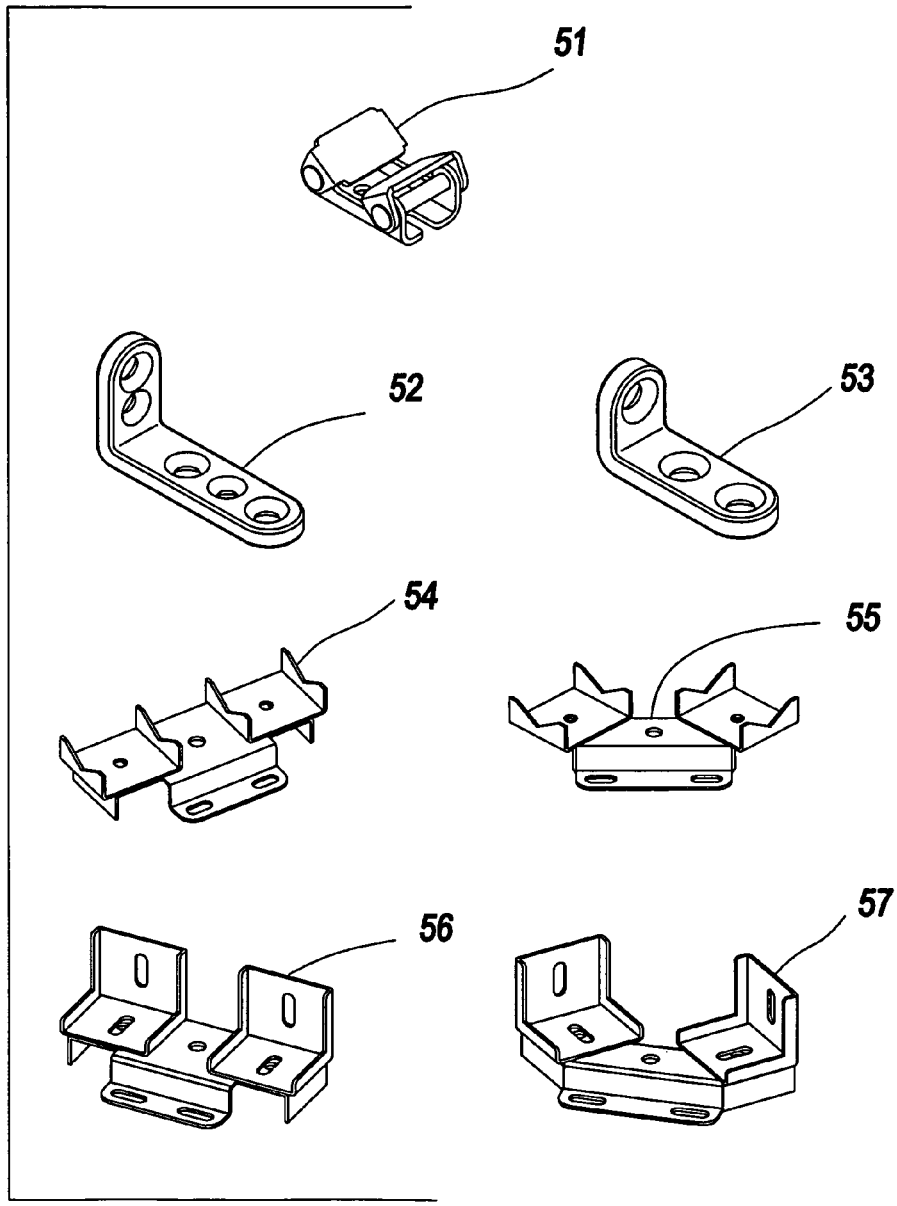
FIG. 9 shows a number of the possible designs of clamping jaws and accessories, for example, the V-pad, the L-shape links, the 180 degree V-angle bracket, the 90 degree V-angle bracket, the 180 degree L-angle bracket, and the 90 degree L-angle bracket.
Figure 10:
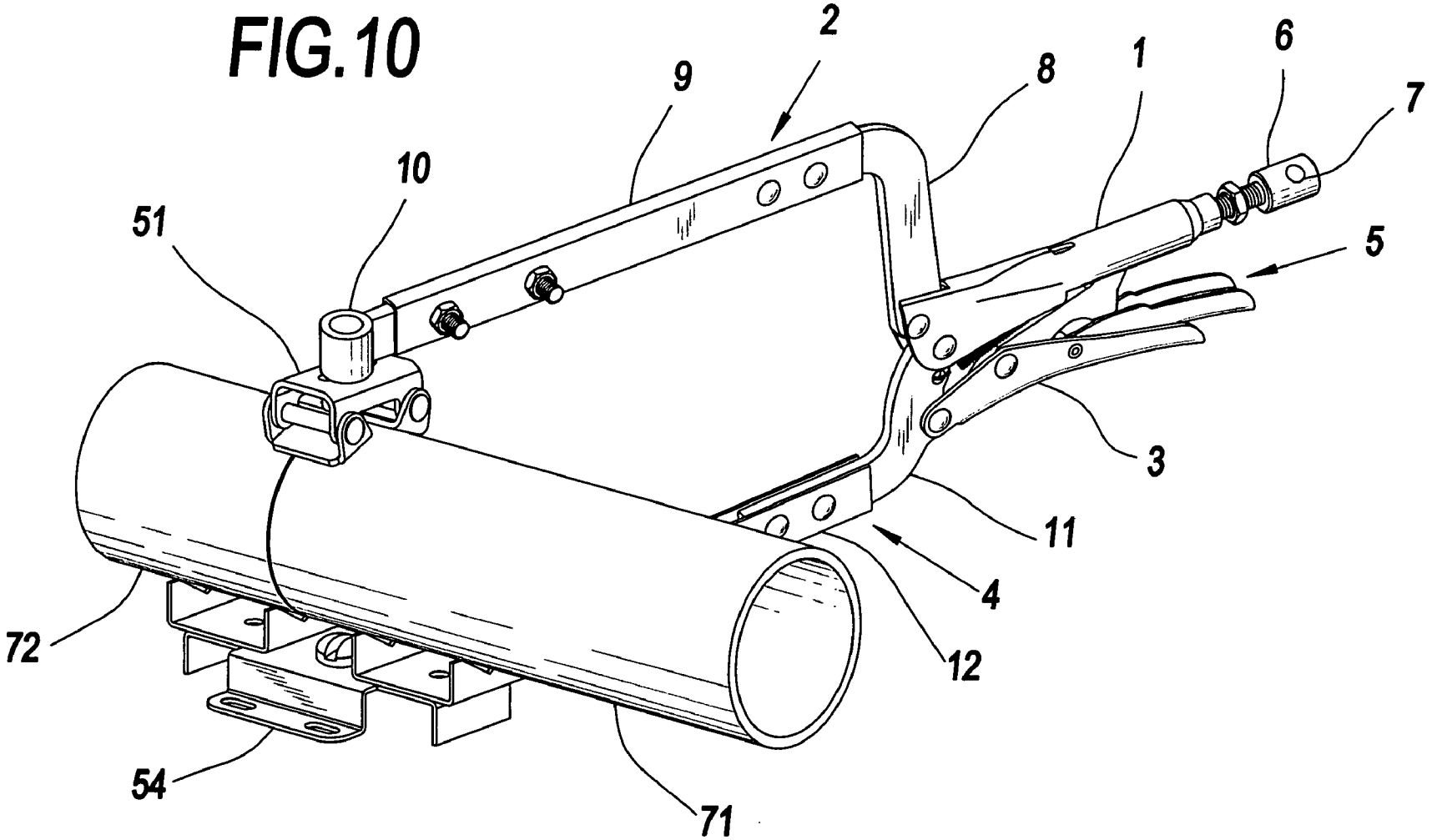
FIG. 10 is a perspective view of the present invention clamping two cylindrical pipes in-line between the V-pad and the 180 degree V-angle bracket.

A wide variety of clamping jaws and accessories can be attached to the present invention to suit various clamping applications. Some examples of the clamping jaws and accessories are shown in FIG. 9: a V-pad 51 for clamping cylindrical workpieces; a long L-shape link 52 and a short L-shape link 53 for joining two sets of the present invention to clamp more workpieces together; a 180 degree V-angle bracket 54 for clamping two cylindrical workpieces in-line, as demonstrated by FIG. 10, workpieces 71 and 72 are clamped under the V-pad 51; a 90 degree V-angle bracket 55 for holding two cylindrical workpieces at 90 degree relationship; a 180 degree L-angle bracket 56 for joining two rectangular workpieces in-line; and a 90 degree L-angle bracket 57 for clamping two rectangular workpieces at 90 degree relationship, as illustrated in FIG. 8, workpieces 61 and 62 are clamped under the yoke assembly 30.

Figure 11:
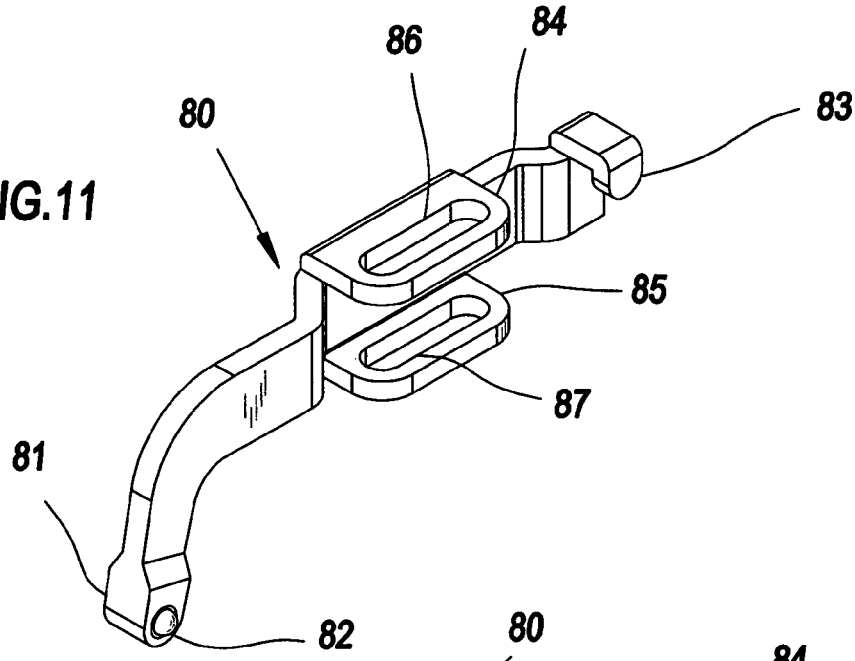
FIG. 11 is a perspective view of the L-shape clamping arm with round tip.
Figure 12:
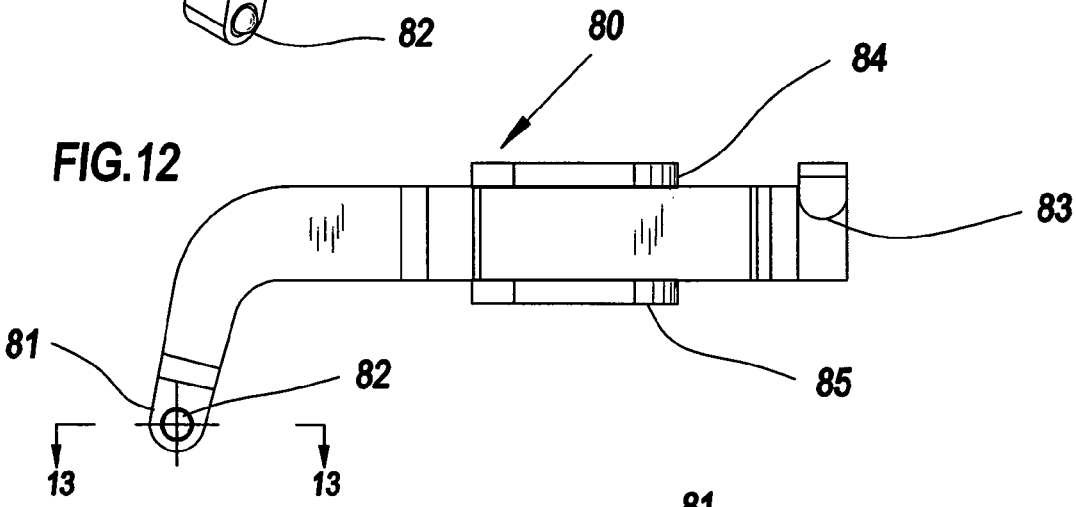
FIG. 12 is a side elevation of the L-shape clamping arm with round tip.
Figure 13:
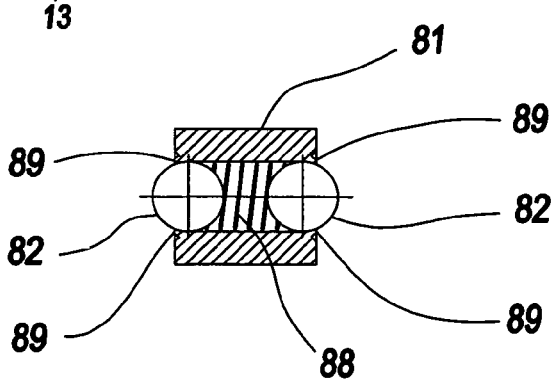
FIG. 13 is a cross-sectional view of the area cut along 13—13 of FIG. 12.
Figure 14:
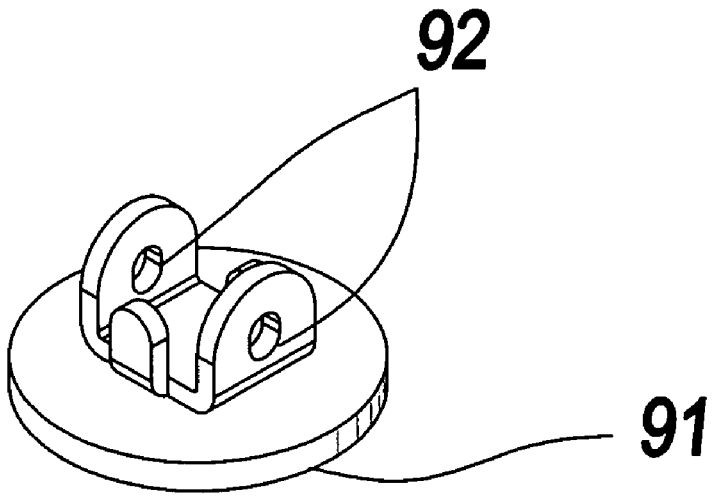
FIG. 14 is a perspective view of the slip-on jaw.
Figure 15:
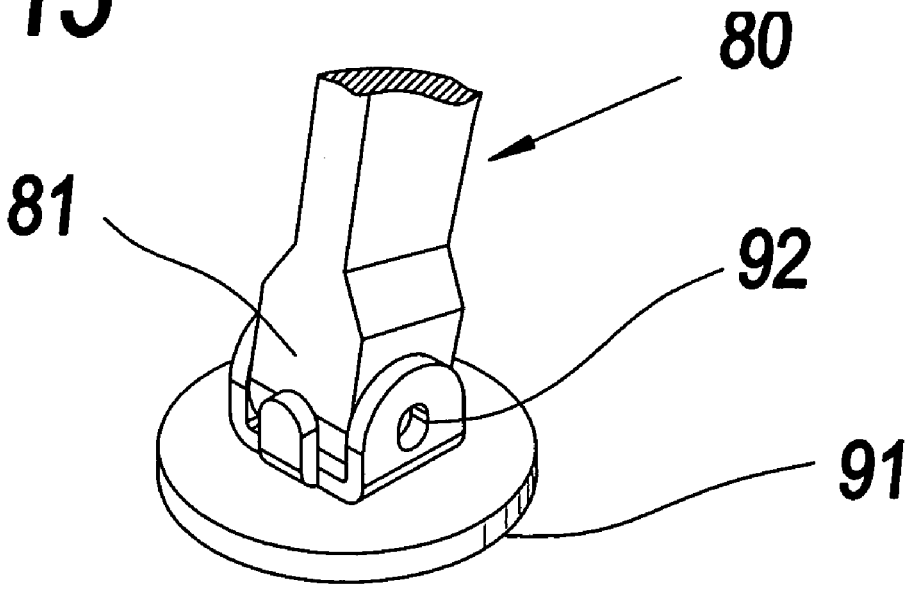
FIG. 15 is a perspective view of the slip-on jaw slipped on the round tip of the L-shape clamping arm.
Figure 16:
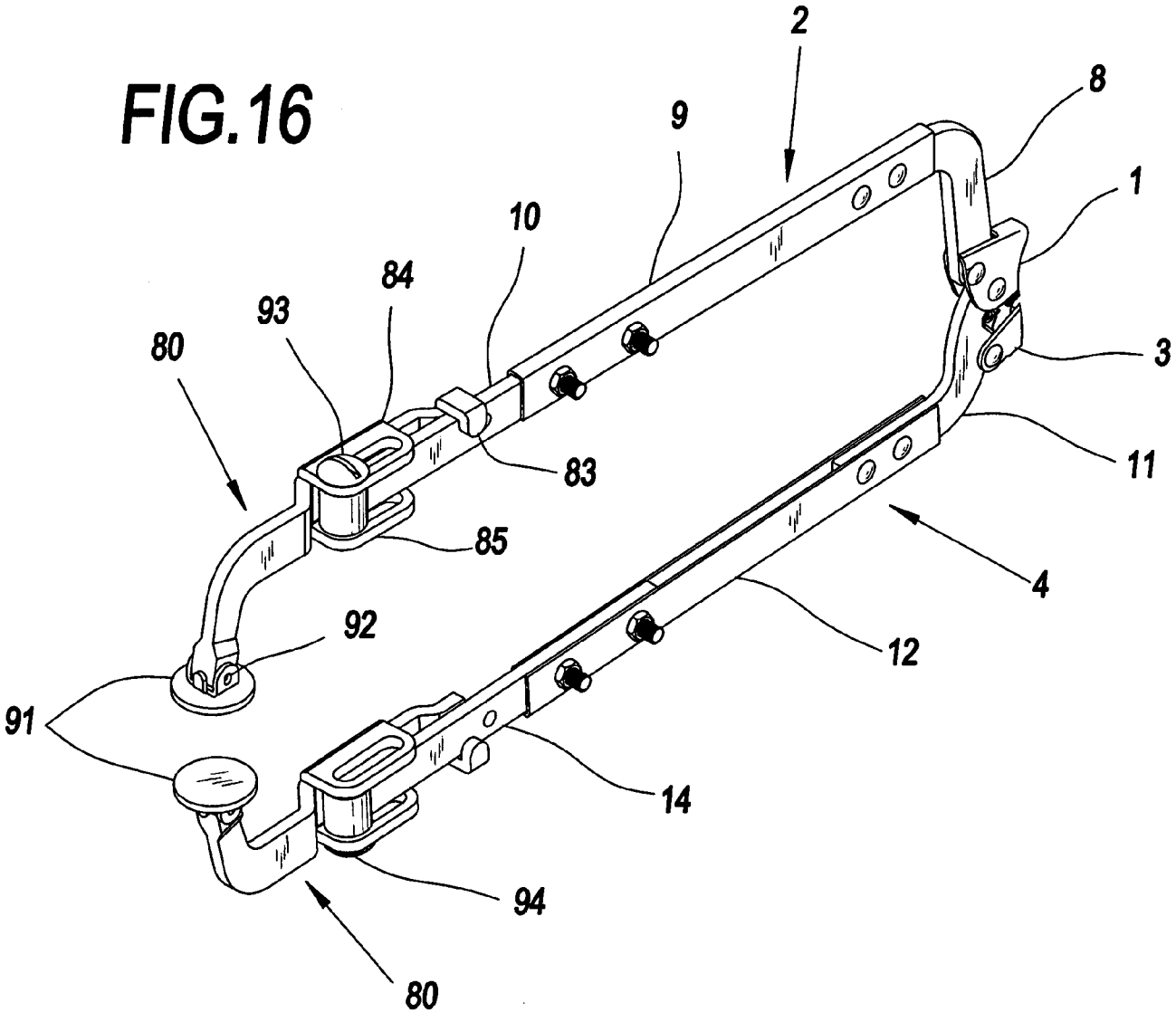
FIG. 16 is a perspective view of the L-shape clamping arms attached to the fixed arm and the movable arm by screws.

FIG. 11 shows the perspective view of another attachment, a L-shape clamping arm 80 with round tip 81 while FIG. 12 is the side elevation of it. The L-shape clamping arm 80 is a L-shape metal shank with an upper mounting plate 84 and a lower mounting plate 85 located at the middle portion and a locating ear 83 at one end. The other end is a round tip 81 for clamping a workpiece. An elongated hole 86 is equipped at the center of the upper mounting plate 84 and an elongated hole 87 is made at the center of the lower mounting plate 85. As shown in FIG. 16, one L-shape clamping arm 80 is mounted to the second upper straight shank 10 inserted between the upper mounting plate 84, lower mounting plate 85 and locating ear 83 with screw 93; similarly, another L-shape clamping arm 80 is mounted to the second lower straight shank 14 with screw 94. With such an arrangement, the present invention is converted to a locking plier with round clamping tips and the effective length of both the fixed arm 2 and the movable arm 4 are further extended. To further enhance the flexibility of the present invention, the round tip 81 of the L-shape clamping arm 80 is equipped with two steel balls 82, one on each side of the round tip 81, as shown on FIG. 11 and FIG. 12. The steel balls 82 are spring loaded internally by helical spring 88 as shown on the cross-sectional view FIG. 13. Circular flanges 89 are formed on each side of the round tip 81 to retain the steel balls 82 in position. FIG. 14 is a slip-on jaw 91 which can easily be slipped onto the steel balls 82 and kept in position with two elongated holes 92, as shown in FIG. 15. FIG. 16 shows two sets of the L-shape clamping arms 80, one attached to the extended fixed arm 2 and the other one attached to the extended movable arm 4, both L-shape clamping arms 80 are added with the slip-on jaws 91 to form a locking plier with extra long clamping arms and with swivel flat clamping surfaces.

What I claim as my invention is:

1. A multi-purpose locking plier having a fixed handle and a movable handle linked together by a spring and a toggling linkage mechanism similar to the design of a conventional locking plier comprising:

a L-shape extendable fixed arm with one end riveted to a first end of said fixed handle and the other end made to be cylindrical in shape with a first threaded hole;

a L-shape extendable movable arm with one end pivoted to one end of said movable handle and the other end made to be cylindrical in shape with a second threaded hole;

an adjustment screw fed into a second end of said fixed handle, said adjustment screw having a cylindrical head with a cylindrical hole made perpendicular to its axis;

a plurality of clamping heads, each with a unique design feature and a threaded rod being fed into said first threaded hole of said L-shape extendable fixed arm or said second threaded hole of said L-shape extendable movable arm, including: a fixed clamping pad, a swivel clamping pad, a rubber clamping pad, and a yoke assembly; and a plurality of accessories, each with a unique design feature and a hole being attached with screw to said first threaded hole of said L-shape extendable fixed arm or said second threaded hole of said L-shape extendable movable arm, including: a V-pad, a long L-shape link, a short L-shape link, a 180 degree V-angle bracket, a 90 degree V-angle bracket, a 180 degree L-angle bracket, a 90 degree L-angle bracket, a support bar, and a L-shape clamping arm with slip-on jaw.

2. The multi-purpose locking plier according to claim 1, wherein said L-shape extendable fixed arm comprising an upper L-shape metal shank, a first upper straight shank with inverted U-shape cross section, and a second upper straight shank made of solid metal inserted and slidable inside said first upper straight shank;

one end of said first upper straight shank being riveted to one end of said upper L-shape metal shank;

said second upper straight shank, similar in length as said first upper straight shank being fixed at a plurality of positions with screws and nuts through a plurality of holes on the bodies of both said first upper straight shank and said second upper straight shank.

3. The multi-purpose locking plier according to claim 2, wherein one end of said second upper straight shank is cylindrical in shape with its axis perpendicular to said second upper straight shank and said first threaded hole is made along said axis.

4. The multi-purpose locking plier according to claim 1, wherein said L-shape extendable movable arm comprising a lower L-shape metal shank, a first lower straight shank with U-shape cross section, and a second lower straight shank made of solid metal inserted and slidable inside said first lower straight shank;

one end of said first lower straight shank being riveted to one end of said lower L-shape metal shank;

said second lower straight shank, similar in length as said first lower straight shank being fixed at a plurality of positions with screws and nuts through a plurality of holes on the bodies of both said first lower straight shank and said second lower straight shank.

5. The multi-purpose locking plier according to claim 4, wherein one end of said second lower straight shank is cylindrical in shape with its axis perpendicular to said second lower straight shank and said second threaded hole is made along said axis.

6. The multi-purpose locking plier according to claim 1, wherein said yoke assembly comprises a horizontal straight metal bar with a vertical threaded hole at each end, a threaded rod with clamping pad being fed through each of said vertical threaded hole, and a short threaded rod hinged at the middle of said horizontal straight metal bar.

7. The multi-purpose locking plier according to claim 1, wherein said V-pad is a U-shape metal base bracket to which two U-shape metal brackets are pivoted at each end to form a swivel V-shape clamping head capable of clamping cylindrical workpieces of various diameters.

8. The multi-purpose locking plier according to claim 1, wherein said long L-shape link is a long L-shape metal bar with a plurality of holes on both legs of said long L-shape link for inserting screw to attach to said first threaded hole of said L-shape extendable fixed arm so that a plurality of multi-purpose locking pliers may be connected in a fixed spatial relationship to clamp workpieces together;

said short L-shape link is a short L-shape metal bar with a plurality of holes on both legs of said short L-shape link for inserting screw to attach to said first threaded hole of said L-shape extendable fixed arm so that a plurality of multi-purpose locking pliers may be connected in a fixed spatial relationship to clamp workpieces together.

9. The multi-purpose locking plier according to claim 1, wherein said 180 degree V-angle bracket comprises two sets of V-shape clamping heads welded in-line on a metal bracket with a center hole for inserting screw to attach said 180 degree V-angle bracket to said second threaded hole of said L-shape extendable movable arm;

said 90 degree V-angle bracket comprises two sets of V-shape clamping heads welded at 90 degrees on a metal bracket with a center hole for inserting screw to attach said 90 degree V-angle bracket to said second threaded hole of said L-shape extendable movable arm.

10. The multi-purpose locking plier according to claim 1, wherein said 180 degree L-angle bracket comprises two sets of L-shape clamping heads welded in-line on a metal bracket with a center hole for inserting screw to attach said 180 degree L-angle bracket to said second threaded hole of said L-shape extendable movable arm;

said 90 degree L-angle bracket comprises two sets of L-shape clamping heads welded at 90 degrees on a metal bracket with a center hole for inserting screw to attach said 90 degree L-angle bracket to said second threaded hole of said L-shape extendable movable arm.

11. The multi-purpose locking plier according to claim 1, wherein said supporting bar is a straight metal bar with a center hole for inserting screw to attach said supporting bar to said second threaded hole of said L-shape extendable movable arm.

12. The multi-purpose locking plier according to claim 1, wherein said L-shape clamping arm is a L-shape metal shank with round tip at one end, a locating ear at the other end, an upper mounting plate and a lower mounting plate at the middle portion;

both said upper mounting plate and said lower mounting plate having an elongated hole in the middle respectively enable the mounting of said L-shape clamping arm onto said second upper straight shank or said second lower straight shank with screw to further extend the effective length of said L-shape extendable fixed arm or said L-shape extendable movable arm;

said round tip end of said L-shape clamping arm is equipped with a pair of steel balls loaded by a compressed helical spring internally and retained in position by a circular ring flange outside each of said steel ball to provide a convenient means to add and remove a slip-on jaw;

said slip-on jaw comprises a metal clamping plate on which a U-shape metal bracket is welded, two elongated holes being made on both sides of said U-shape metal bracket, one hole on each side, to hold said slip-on jaw in place by said steel balls when said U-shape metal bracket is slipped on said round tip end of said L-shape clamping arm.

* * * * *